US009528524B2

(12) United States Patent
Guzelgunler

(10) Patent No.: US 9,528,524 B2
(45) Date of Patent: Dec. 27, 2016

(54) PUMP FREEZE PROTECTION

(75) Inventor: Yilcan Guzelgunler, Tipp City, OH (US)

(73) Assignee: Regal Beloit America, Inc., Beloit, WI (US)

( * ) Notice: Subject to any disclaimer, the term of this patent is extended or adjusted under 35 U.S.C. 154(b) by 994 days.

(21) Appl. No.: 13/285,949

(22) Filed: Oct. 31, 2011

(65) Prior Publication Data

US 2013/0108476 A1 May 2, 2013

(51) Int. Cl.

| | |
|---|---|
| ***F04D 15/00*** | (2006.01) |
| ***F04D 15/02*** | (2006.01) |
| ***F04B 49/00*** | (2006.01) |
| ***F04B 49/06*** | (2006.01) |
| ***F04B 49/10*** | (2006.01) |

(52) U.S. Cl.

CPC ..... *F04D 15/0209* (2013.01); *F04B 49/065* (2013.01); *F04B 49/10* (2013.01); *F04D 15/0077* (2013.01); *F04D 15/0263* (2013.01); *F04B 2207/03* (2013.01)

(58) Field of Classification Search

CPC ..... F04B 2201/0801; F04B 2205/10; F04B 2207/03; F04D 15/00; F04D 15/0077; F04D 15/0263

USPC ..... 417/12, 32, 44.1

See application file for complete search history.

(56) References Cited

U.S. PATENT DOCUMENTS

| | | | | |
|---|---|---|---|---|
| 3,902,202 | A | 9/1975 | Strange, Jr. | |
| 4,322,297 | A | 3/1982 | Bajka | |
| 4,685,158 | A | 8/1987 | Lively | |
| 5,559,720 | A | 9/1996 | Tompkins et al. | |
| 6,003,166 | A | 12/1999 | Hald et al. | |
| 7,484,938 | B2 * | 2/2009 | Allen | 417/53 |
| 2002/0020014 | A1 | 2/2002 | Authier et al. | |
| 2007/0061051 | A1 | 3/2007 | Maddox | |
| 2008/0021685 | A1 | 1/2008 | Emery et al. | |

(Continued)

OTHER PUBLICATIONS

Pool and Spa Controls, PF1100 Series Single Circuit Freeze Protection Controls, Available as early as Sep. 21, 2011, 2 pages, <URL: http://www.poolandspacontrols.com/products/freeze protection controls/single circuit freeze protection controls.aspx>.

(Continued)

*Primary Examiner* — Peter J Bertheaud

(74) *Attorney, Agent, or Firm* — Michael Best & Friedrich LLP

(57) ABSTRACT

Systems and methods for preventing water from freezing within a pump system. A pump motor is positioned inside a pump housing. A temperature sensor and a motor controller are positioned inside a motor controller housing. A user interface (UI) controller is positioned in a UI housing. A UI is integrated into the UI housing. The UI controller receives a freeze protection temperature setting through the UI reflecting a difference between an ambient temperature at the location of the motor controller housing and an outdoor temperature and determines a freeze protection temperature threshold based on the setting. The UI controller also receives an adjusted temperature value from the motor controller based on the temperature sensed by the temperature sensor. The UI controller activates the pump motor when the adjusted temperature is below the freeze protection temperature threshold.

18 Claims, 2 Drawing Sheets

(56) References Cited

U.S. PATENT DOCUMENTS

| | | | | |
|---|---|---|---|---|
| 2010/0092308 | A1* | 4/2010 | Stiles et al. | 417/44.11 |
| 2010/0308963 | A1* | 12/2010 | Kidd et al. | 340/5.85 |

OTHER PUBLICATIONS

Pool and Spa Controls, PF1100 and PF1200 Series Multi Circuit Freeze Protection Controls, Available as early as Sep. 21, 2011, 2 pages, <URL: http://www.poolandspacontrols.com/products/freeze protection controls/multi circuit freeze protection controls.aspx>.

Andy, Aqualink Touch Owner's Manual, Available as early as Sep. 21, 2011 68 pp., <URL: http://www.poolcenter.com/jandy-controlsaqualink-touch-OM.pdf>.

Pentair Water, Pool and Spa, IntelliTouch Pool and Spa Control System, 2011, 126 pages, <URL: http://www.pentairpool.com/pdfs/IntelliTouchUG.pdf>.

Hayward, OnCommand Automation Installation Manual for Models' Oncom, Oncom-Act, Oncom-Rc, Oncom-Act-Rc, 2009, 32 pages, <URL: http://www.haywardpool.com/pdf/manuals/Manual369.pdf>.

* cited by examiner

PUMP FREEZE PROTECTION

BACKGROUND

The present invention relates to methods for preventing damage to pump systems caused by freezing water. Particularly in mild climates, pools and spas are used year round. In the winter, temperatures can drop below freezing for extended periods of time. If the pump is not running during freezing temperatures, the water in the pump housing and piping can freeze and cause damage to the pump system.

SUMMARY

In one embodiment, the invention provides a pump system including a pump housing and a controller housing separate from the pump housing. A pump motor is positioned inside the pump housing. A temperature sensor is positioned inside the controller housing. A controller receives a temperature value from the temperature sensor and determines an adjusted temperature value based on the temperature value from the sensor. The controller then activates the pump motor to begin pumping fluid when the adjusted temperature is below a freeze protection temperature threshold.

In some embodiments, the controller receives a freeze protection temperature setting from a user through a user interface and determines the freeze protection temperature threshold based on the freeze protection temperature setting. The freeze protection temperature setting enables the controller to account for differences in the ambient temperature at the location of the controller and the outdoor temperature. By using an adjusted temperature value, the controller is able to adjust the temperature value to account for heat generated by the controller.

In another embodiment the invention provides a method of preventing a fluid from freezing in a pump system. A temperature value is received from a temperature sensor positioned within a controller housing. A controller determines an adjusted temperature value based on the temperature value from the temperature sensor and activates a pump motor to begin pumping a fluid when the adjusted temperature is below a freeze protection temperature threshold. The pump motor is positioned in a pump housing separate from the controller housing.

In another embodiment, the invention provides a pump system comprising a pump housing, a motor controller housing, and a user interface (UI) housing. A pump motor is positioned inside the pump housing. A temperature sensor and a motor controller are positioned inside the motor controller housing. A UI controller is positioned in the UI housing. A UI is integrated into the UI housing. The UI controller receives a freeze protection temperature setting through the UI reflecting a difference between an ambient temperature at the location of the motor controller housing and an outdoor temperature and determines a freeze protection temperature threshold based on the setting. The UI controller also receives an adjusted temperature value from the motor controller based on the temperature sensed by the temperature sensor. The UI controller activates the pump motor when the adjusted temperature is below the freeze protection temperature threshold.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
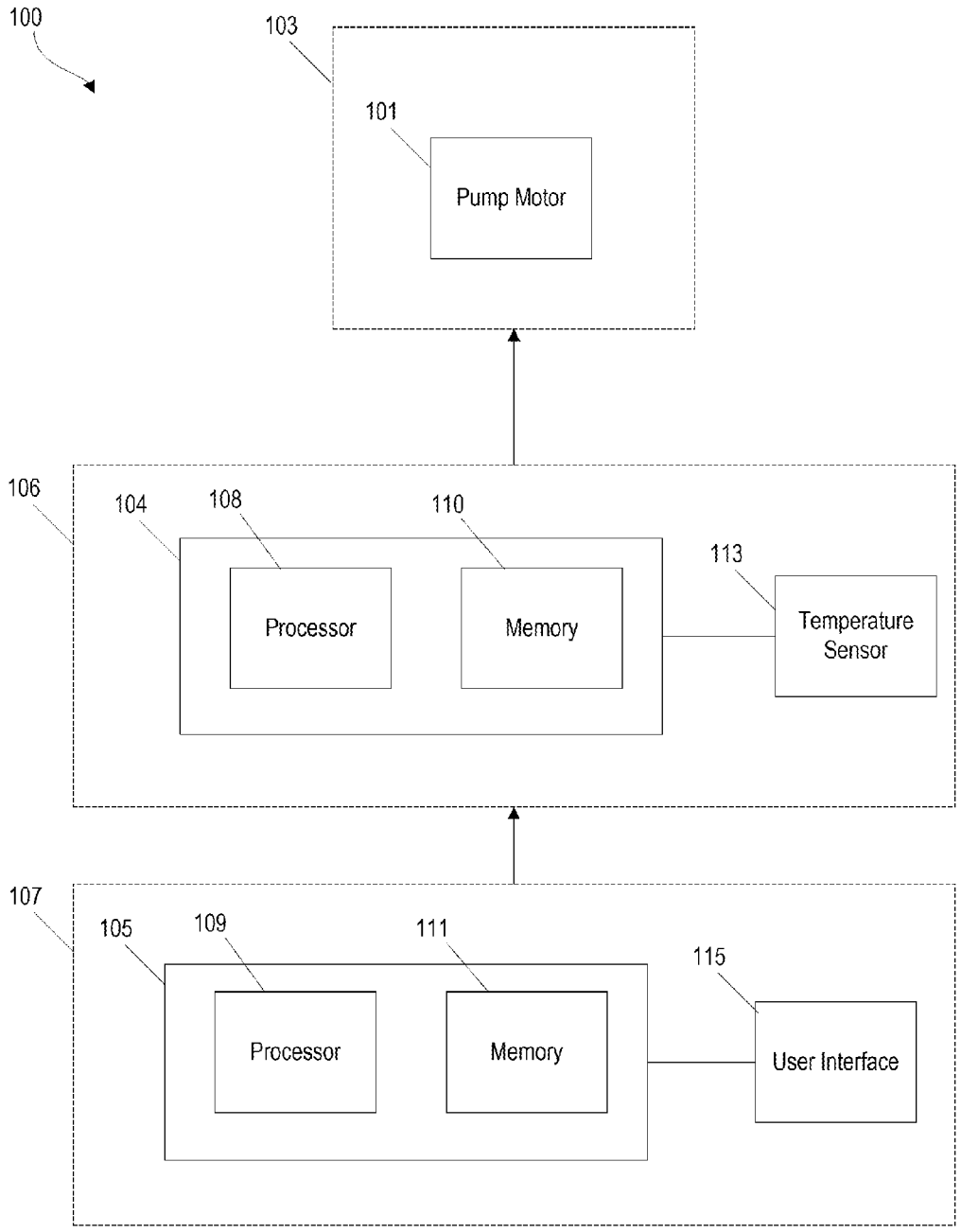
FIG. 1 is a block diagram of one embodiment of a pump system.

FIG. 1 illustrates a pump system 100 for use in systems such as a pool or a spa. A pump motor 101 is positioned within a pump housing 103. A user interface (UI) controller 105 is positioned within a user interface (UI) housing 107. The UI housing 107 is separate from the pump housing 103 and, in some situations, is located remotely from the pump housing. The controller 105 is communicatively connected through a wired or wireless connection to a motor controller 104 housed within a motor controller housing 106. The motor controller housing 106 in FIG. 1 is separate from the pump housing 103. However, in some systems, the controller and the pump are positioned within the same housing. The motor controller 104 is connected to the pump motor 101, controls the operation of the pump motor 101 and, thereby, enables the pump motor 101 to perform functions such as, for example operating the filter system of a pool or a spa.

The UI controller 105 includes a processor 109 and a memory 111. The memory 111 stores operational data for the pump system 100 and also stores computer executable instructions that are executed by the processor 109 enabling the processor to control various operations of the pump system 100. The motor controller 104 also includes a processor 108 and a memory 110. The motor controller 104 produces heat even when the pump motor 101 is not operating. To prevent the motor controller 104 from overheating, a temperature sensor 113 is also positioned within the motor controller housing 106. The motor controller 104 receives temperature values from the temperature sensor 113. If the temperature value exceeds a controller overheat temperature threshold, the motor controller 104 will indicate an error condition and may take remedial action (e.g., powering itself down) to prevent damage to the motor controller 104.

The UI controller 105 is connected to a user interface 115 integrated into the UI housing 107. The components of the user interface 115 vary depending upon the particular pump system. The user interface 115 may include a plurality of buttons, dials, or other devices for providing data and pump settings to the UI controller 105. The user interface may also include one or more output devices such as an LCD screen, one or more LED indicators, or other auditory or visual devices for providing messages and other indicators to a user.

The UI controller 105 interacts with the motor controller 104 to control the operation of the pump motor and implement proper operation of the pump system 100. In some embodiments, the memory 110 of the motor controller 104 stores a pump operation schedule. The pump operation schedule defines when the pump motor should be operated in order to achieve a desired result. A user can adjust the pump settings and the pump operation schedule through the user interface 115.

When the pump system 100 operates in colder climates or during colder temperatures, water flowing within the pump system may freeze. Frozen water within the pump system 100 prevents the pump system 100 from operating properly. Furthermore, because freezing water expands, frozen water can cause damage to the pump system 100. One way to prevent water from freezing inside the pump system 100 is to operate the pump motor 101 and force the water to move through the pump system 100 instead of remaining stagnant.

Figure 2:
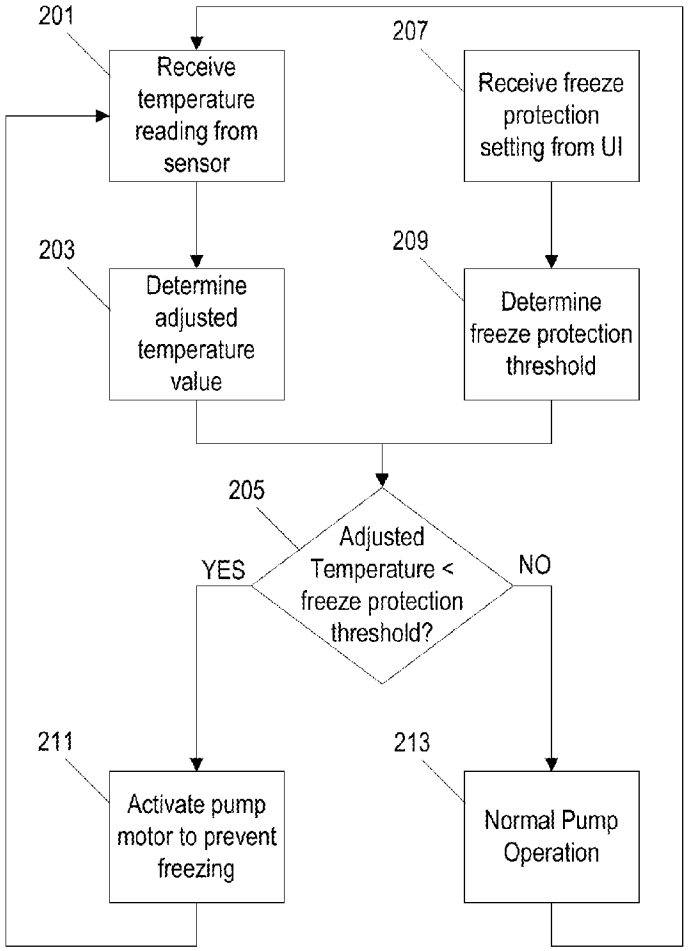
FIG. 2 is a flowchart of a method of preventing water from freezing in the pump system of FIG. 1.

FIG. 2 illustrates a method of operating the pump system 100 to prevent the water within the system from freezing. The motor controller 104 receives a temperature value from the temperature sensor 113 (step 201). The motor controller 104 then determines an adjusted temperature value based on the temperature value received from the temperature sensor 113 (step 203). As noted above, the motor controller 104 produces heat when operating. Adjusting the temperature value received from the temperature sensor accounts for this additional heat source. The adjusted temperature value is determined by accessing a temperature map stored on the memory 110 and determining an adjusted temperature value that corresponds to the temperature value sensed by the temperature sensor 113. Some systems are configured to generate and update the temperature map based on observed operating conditions. In other systems, the method of determining the adjusted temperature value is defined at the time of manufacture and programmed to the controller.

The adjusted temperature value is then transmitted to the UI controller 105 and compared to a freeze protection temperature threshold (step 205) to determine if conditions exist under which the water in the pump system 100 could freeze. However, in other systems, the motor controller 104 sends the raw temperature value to the UI controller 105 which then calculates the adjusted temperature value. The motor controller housing 106 may be positioned in a sheltered location, such as a pool shed. As such, the ambient temperature around the motor controller housing 106 may differ from the outdoor temperature and, therefore, the temperature of water in pipes. To account for such differences in temperature, the pump system 100 is configured to receive a freeze protection temperature setting from a user through the user interface 115 (step 207). The controller 105 uses the freeze protection temperature setting from the user interface 115 to determine the freeze protection temperature threshold (step 209). The freeze protection temperature setting may be a specific temperature value indicating the difference in the ambient temperature near the motor controller housing 106 and the outdoor temperature. In other embodiments, the freeze protection temperature setting may be an adjustment factor that the controller uses to calculate a freeze protection temperature threshold.

If the adjusted temperature value is less than the freeze protection temperature threshold, then the UI controller 105 instructs the motor controller 104 to activate the pump motor 101 and begin pumping water through the pump system to prevent the water from freezing (step 211). The pump system continues to operate in this "freeze protection mode" until the adjusted temperature value exceeds the freeze protection temperature threshold. In some systems, the UI controller 105, via the motor controller 104, runs the pump motor 101 constantly until the adjusted temperature value exceeds the freeze protection temperature threshold. In other systems, the UI controller 105 implements an alternate pump operation schedule when operating in the freeze protection mode. The alternate pump operation schedule in some systems repeatedly activates and deactivates the pump motor 101 for defined periods of time until the adjusted temperature value exceeds the freeze protection temperature threshold. In still other systems, the UI controller 105 runs the pump motor 101 for a defined period of time before again comparing the adjusted temperature to the freeze protection temperature threshold. If the adjusted temperature exceeds the freeze protection temperature threshold after the defined period of time has elapse, then the UI controller 105 stops the motor. Otherwise, the UI controller 105 continues to run the pump motor.

If the adjusted temperature value is greater than the freeze protection temperature threshold, then the controller 105 continues with normal operation of the pump motor (step 213). As illustrated in the method of FIG. 2, the freeze protection functionality overrides the normal operation of the system. Therefore, when freezing conditions are detected, the pump motor 101 may be activated even if the pump operation schedule dictates that the pump should be turned off at that time.

Figure 3:
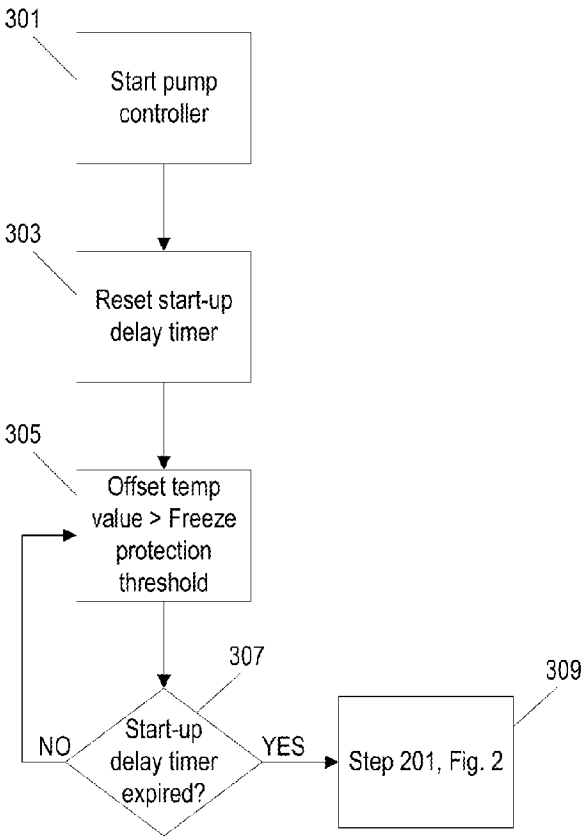
FIG. 3 is a flowchart of a start-up routine for the pump system of FIG. 1.

As described above, the motor controller 104 determines an adjusted temperature value to account for heat generated by the motor controller 104 during operation. However, when the motor controller 104 is first turned on, it has not yet generated the same heat within the motor controller housing 106. Therefore, the same adjusted temperature value will not be applicable. FIG. 3 illustrates a method to prevent the system 100 from indicating a false freezing condition while the motor controller housing 106 reaches temperature equilibrium immediately after the motor controller 104 has been started.

When the motor controller 104 is started (step 301), the motor controller 104 resets a start-up delay timer (step 303). The adjusted temperature value determined by the motor controller 104 and sent to the UI controller 105 is then set to a value that is greater than the freeze protection temperature threshold (step 305), thereby ensuring that the "freeze protection mode" (step 211, FIG. 2) will not be activated during this start-up period. The motor controller 104 continues to set the adjusted temperature value to a value above the freeze protection temperature threshold until the start-up delay timer has expired (step 307). The motor controller 104 then returns to calculating the adjusted temperature value as described above in reference to FIG. 2 (step 309). Other systems account for this equilibrium adjustment time period by including a different method/temperature map for determining the adjusted temperature value during the start-up period. Still other systems will disable the freeze protection functionality of the UI controller 105 until the start-up delay timer has expired.

Thus, the invention provides, among other things, a system and method for preventing water from freezing in a pump system by reading a temperature within a controller housing and comparing the temperature to a freeze protection temperature threshold while accounting for differences in heat attributable other sources. The specific constructions described above are exemplary—the invention can be implement by other constructions and methods. For example, in the system described above, the freeze protection temperature setting received through the user interface is used to adjust the freeze protection temperature threshold. However, in certain other constructions, the freeze protection setting received through the user interface is used to calculate the adjusted temperature value. Similarly, although the system described above accounts for heat generated by the controller and other electronics within the controller housing by adjusting the temperature value, in certain other construction, these heat sources are accounted for by adjusting the freeze protection temperature threshold. Various features and advantages of the invention are set forth in the following claims.

What is claimed is:

1. A pump system comprising:

a pump housing;

a pump motor inside the pump housing; a controller housing separate from the pump housing;

a temperature sensor inside the controller housing; and a controller including a processor and a computer readable memory storing instructions that, when executed by the processor, cause the controller to receive a temperature value from the temperature sensor, determine an adjusted temperature value based on the temperature value from the temperature sensor, wherein the adjusted temperature value compensates for heat generated by the controller such that the adjusted temperature value is less than the temperature value from the temperature sensor, and activate the pump motor to begin pumping of a fluid when the adjusted temperature is below a freeze protection temperature threshold.

2. The pump system of claim 1, wherein the instructions, when executed by the processor, further cause the controller to receive a freeze protection temperature setting from a user through a user interface, and determine the freeze protection temperature threshold based on the freeze protection temperature setting.

3. The pump system of claim 1, wherein the instructions, when executed by the processor, further cause the controller to receive a freeze protection temperature setting from a user through a user interface, and wherein the adjusted temperature value is further determined based on the freeze protection temperature setting.

4. The pump system of claim 1, wherein the instructions, when executed by the processor, further cause the controller to determine a controller overheat temperature threshold, and indicate an error condition when the temperature value from the temperature sensor exceeds the controller overheat temperature threshold.

5. The pump system of claim 1, wherein the instructions, when executed by the processor, further cause the controller to establish a pump operation schedule, operate the pump motor according to the pump operation schedule, and override the pump operation schedule when the adjusted temperature is below the freeze protection temperature threshold.

6. The pump system of claim 1, wherein the instructions, when executed by the processor, further cause the controller to determine a freeze protection time period, activate the pump motor for the freeze protection time period when the adjusted temperature is below the freeze protection temperature threshold, and deactivate the pump motor after the freeze protection time period has expired.

7. The pump system of claim 1, wherein the instructions, when executed by the processor cause the controller to determine the adjusted temperature value by accessing a temperature map profile stored on the memory, and determining the adjusted temperature value corresponding to the temperature value from the temperature sensor according to the temperature map profile.

8. A pump system comprising:

a pump housing;

a pump motor inside the pump housing;

a controller housing separate from the pump housing;

a temperature sensor inside the controller housing;

a controller including a processor and a computer readable memory storing instructions that, when executed by the processor, cause the controller to receive a temperature value from the temperature sensor, determine an adjusted temperature value based on the temperature value from the temperature sensor, wherein the adjusted temperature value compensates for heat generated by the controller, and activate the pump motor to begin pumping of a fluid when the adjusted temperature is below a freeze protection temperature threshold;

wherein the instructions, when executed by the processor, further cause the controller to initiate a start-up delay period when the controller is powered on, and set the adjusted temperature value as a value that exceeds the freeze protection temperature threshold during the start-up delay period.

9. The pump system of claim 1, wherein the controller includes a motor controller and a user interface controller, and the pump system further comprising the motor controller positioned within the controller housing; and the user interface controller positioned within a user interface housing, wherein the motor controller operates the motor based on signals from the controller, and wherein the motor controller receives the temperature value from the temperature sensor and provides the adjusted temperature value to the user interface controller.

10. A method of preventing a fluid from freezing in a pump system, the method comprising:

receiving a temperature value from a temperature sensor positioned within a controller housing;

determining, by a controller, an adjusted temperature value based on the temperature value from the temperature sensor, wherein the adjusted temperature value compensates for heat generated by the controller such that the adjusted temperature value is less than the temperature value from the temperature sensor; and activating a pump motor to begin pumping a fluid when the adjusted temperature is below a freeze protection temperature threshold.

11. The method of claim 10, further comprising the acts of:

receiving a freeze protection temperature setting from a user through a user interface, and determining the freeze protection temperature threshold based on the freeze protection temperature setting.

12. The method of claim 10, further comprising the act of receiving a freeze protection temperature setting from a user through the user interface, and wherein the adjusted temperature value is further determined based on the freeze protection temperature setting.

13. The method of claim 10, further comprising the acts of:

determining a controller overheat temperature threshold, and indicating an error condition when the temperature value from the temperature sensor exceeds the controller overheat temperature threshold.

14. The method of claim 10, further comprising the acts of:

establishing a pump operation schedule, operating the pump motor according to the pump operation schedule, and overriding the pump operation schedule when the adjusted temperature is below the freeze protection temperature threshold.

15. The method of claim 10, further comprising the acts of:

determining a freeze protection time period, activating the pump motor for the freeze protection time period when the adjusted temperature is below the freeze protection temperature threshold, and deactivating the pump motor after the freeze protection time period has expired.

16. The method of claim 10, wherein the act of determining the adjusted temperature value includes accessing a temperature map profile stored on the memory, and determining the adjusted temperature value corresponding to the temperature value from the temperature sensor according to the temperature map profile.

17. The method of claim 10, further comprising the acts of: initiating a start-up delay period when the controller is powered on, and setting the adjusted temperature value as a value that exceeds the freeze protection temperature threshold during the start-up delay period.

18. The method of claim 10, wherein the controller includes a motor controller and a user interface controller, wherein the motor controller is positioned within the controller housing and the user interface controller is positioned within a user interface housing, and wherein the motor controller receives the temperature value from the temperature sensor and provides the adjusted temperature value to the user interface controller.

* * * * *